US005465511A

United States Patent [19]

Umberson

[11] Patent Number: 5,465,511

[45] Date of Patent: Nov. 14, 1995

[54] TRENCHING MACHINE

[75] Inventor: Gerald E. Umberson, Midland, Tex.

[73] Assignee: Capitol Trencher Corporation, Odessa, Tex.

[21] Appl. No.: 92,227

[22] Filed: Jul. 15, 1993

[51] Int. Cl.[6] ..... E02F 5/06

[52] U.S. Cl. ..... 37/355; 37/351

[58] Field of Search ..... 37/355, 94, 349, 37/350, 351, 352, 353, 354, 355, 356, 357, 358, 359, 360; 299/1.4, 39; 172/112, 114; 241/101.7, 186.3, 189.1, 202, 265; 405/36, 43, 45, 303

[56] References Cited

U.S. PATENT DOCUMENTS

| | | | |
|---|---|---|---|
| 2,735,667 | 2/1956 | Potvin | 299/1.4 X |
| 2,756,038 | 7/1956 | Barrett | 299/1.4 X |
| 4,637,753 | 1/1987 | Swisher, Jr. | 404/90 X |
| 4,890,399 | 1/1990 | Stiff et al. | 37/86 |
| 4,908,967 | 3/1990 | Leece | 37/192 X |
| 5,259,692 | 11/1993 | Beller et al. | 404/90 X |

*Primary Examiner*—Randolph A. Reese
*Assistant Examiner*—Robert Pezzuto
*Attorney, Agent, or Firm*—Lyon & Lyon

[57] ABSTRACT

In a machine for digging a trench, in which the digging apparatus comprises an elongated boom having a movable chain around its periphery and which is lowered into the ground, the problem of dislodged boulders which heretofore would be excavated into the machine where they often damaged the conveyor belt system or became stuck, is prevented by an elongate bar or drum which is attached to the frame of the machine in close proximity to the operating chain and immediately before the boulder would otherwise enter the machine. The boulder is held there until it either breaks apart or its abraded by further action of the chain to a sufficiently small size that it can safely navigate through the machine and be expelled in the normal course.

18 Claims, 3 Drawing Sheets

TRENCHING MACHINE

BACKGROUND

1. Field of the Invention

This invention pertains generally to trenching machines. Specifically, this invention pertains to an improvement to such a machine, whereby boulders which are excavated intact are crushed prior to being deposited onto the refuse conveyor belt.

2. Prior Art

The device with which the present invention will find primary utility is the large trenching machine. These machines are used to dig the trenches in the ground into which pipe, power line, cables and other apparatus are laid. Often, these machines are used to dig trenches spanning distances up to hundreds and even thousands of miles, with the resultant trenches being up to 10 ft. or more deep and 6 ft. or more wide. The earthen material to be trenched can range from soft dirt to rock harder than concrete. Regardless of the hardness of the material being trenched, a particular problem is presented by rocks and boulders which are often encountered and dislodged intact by the machine.

When such a large rock or boulder is encountered, one of three things typically happens. If the boulder is so large, so hard and so firmly embedded that the trenching machine cannot break or remove it, the trenching operation slows considerably as the trenching machine digs its way through the large boulder. This slows the operation, but is not a problem otherwise. Or, the boulder may be broken into several small pieces when hit by the trenching machine, in which case the smaller pieces are removed by the machine from the trench in the normal course and the progress of the machine proceeds unimpeded. Lastly, however, and this is often the case, the entire boulder is dislodged intact, and is then excavated from the trench by the machine and transported to the conveyer belt where it is literally dropped onto the conveyer belt along with the surrounding earth and matter.

Several problems may be encountered when this occurs. First, the conveyer belt or its underpinnings may be damaged when the large, heavy boulder is dropped upon it. Second, even if the conveyer belt is not damaged, the boulder may be too large to fit through the "window" in the frame of the trencher through which the dirt is expelled. In that case, the boulder becomes wedged in the window in the frame, requiring that the trenching operation be stopped completely while the rock is removed. Even if the rock or boulder is small enough to exit the trencher, it cannot be used for back filling the trench after the pipe or other apparatus is laid. Accordingly, that boulder either remains at the site or, as is most often the case, must be transported elsewhere.

The trenching machines with which this invention is primarily used have been in existence for several years. These devices typically comprise a large track-laying motorized vehicle, which is used both to move the trencher forward and to provide a power take-off source for the trenching component of the device. Various types of trenching components are known and used. One is a rotating trenching wheel having buckets which cut the trench and excavate the dislodged earthen material from the trench; another is referred to as a "chain-saw" type trenching component, which resembles a large chain-saw blade attached to and powered by the track-laying vehicle. The "chain-saw" portion typically comprises a large elongated boom around the periphery of which travels a digging belt having a combination of digging teeth which simultaneously cut the earthen material to be extracted and then carry it out of the trench into the body of the trenching component, where it is deposited on a transversely-running conveyor belt which moves the dirt and other material extracted to the side of the trench. After the pipe (or other apparatus) is laid in the trench, the extracted dirt is used to refill the trench. This invention is intended for use with this boom-type trenching machine.

None of the existing prior art trenching machines deal effectively with the problems posed by these dislodged boulders. One attempted solution was to make the "window" in the frame larger, but the problems of damage to the conveyor system and of having the boulders at the trench-site remained. Therefore, a need exists in the field of largescale trenching machines for an improved trencher which will overcome these deficiencies of the prior art.

SUMMARY OF INVENTION

This invention provides such an improved trenching machine by incorporating a device which crushes most of the boulders removed before they reach the interior of the trencher and the conveyer belt, the invention comprising a preferably rotating bar-like element attached to the frame of the machine in close proximity to the digging belt and the ground such that dislodged boulders are prevented from entering the machine until broken up or ground down to a manageable size.

One embodiment of this invention is shown in the attached drawings, wherein the bar-like element comprises a crusher drum attached to the frame of the machine in close proximity to the digging belt. In operation, any boulders that are dislodged by the digging belt are moved up and out of the hole and come against the crusher drum which impedes its progress. At this point, the combined forces of the crusher drum, the digging belt and the ground may force the boulder to crumble. If not, the boulder remains lodged in that location while the digging belt continues to travel over it, abrading it until it is reduced to a size that can travel through the space between the crusher drum and the digging belt.

It is, therefore, the object of this invention to provide an improved trenching machine.

DESCRIPTION OF THE PREFERRED EMBODIMENT

Figure 1:
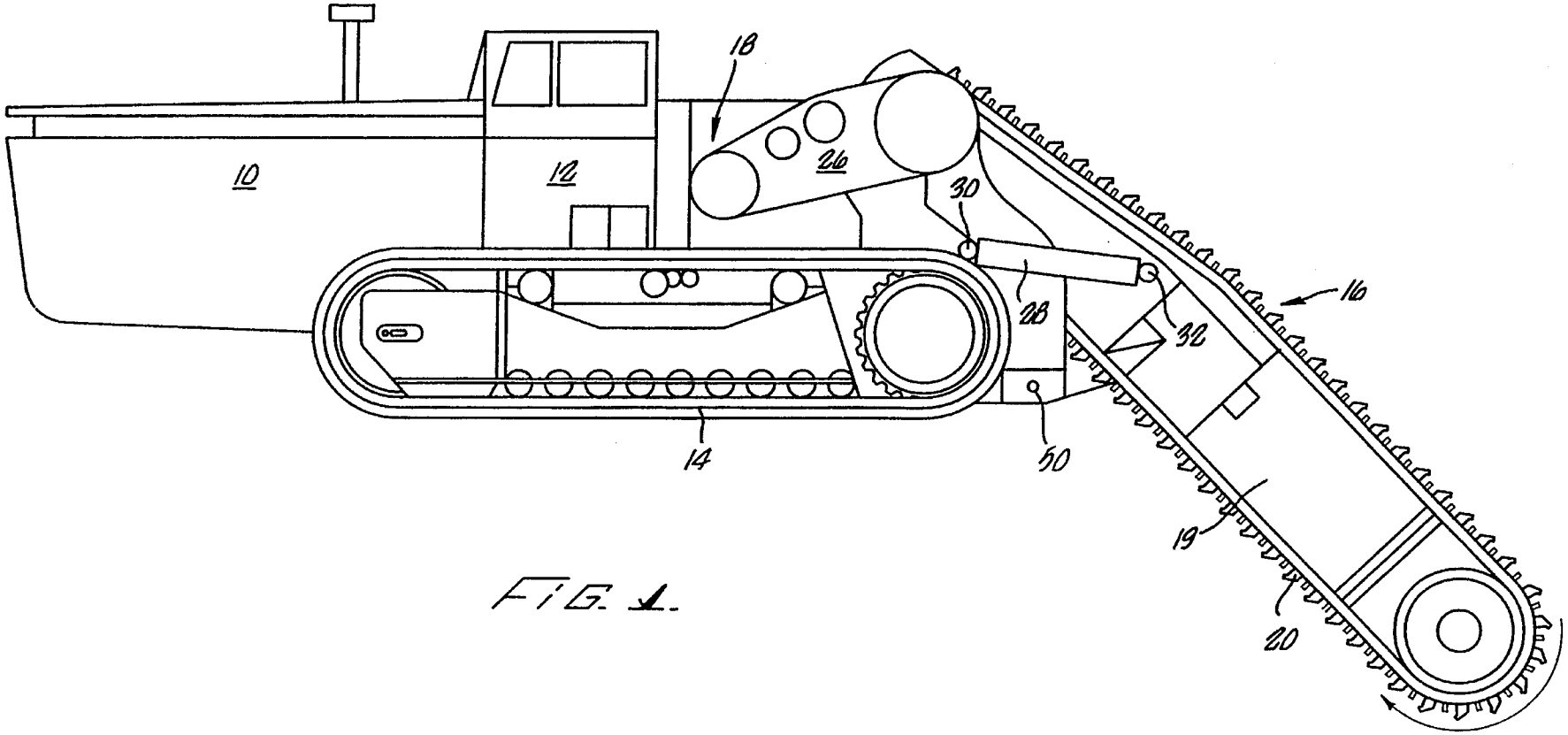
FIG. 1 is a side view depiction of a typical boom-type tractor trencher of the type with which this invention will find primary utility. The boom is depicted in the lowered or digging position.

The preferred trencher will have a central frame (not shown), attached to which are an engine compartment 10, an enclosed cab 12, a track system 14, and a hydraulically adjustable boom assembly 16, rotatably attached to the central frame by means of boom frame 18. The boom assembly 16 generally comprises a boom 19, and a digging belt 20 which is attached to two chains 21 which travel within a track around the periphery of the boom 19.

Figure 3:
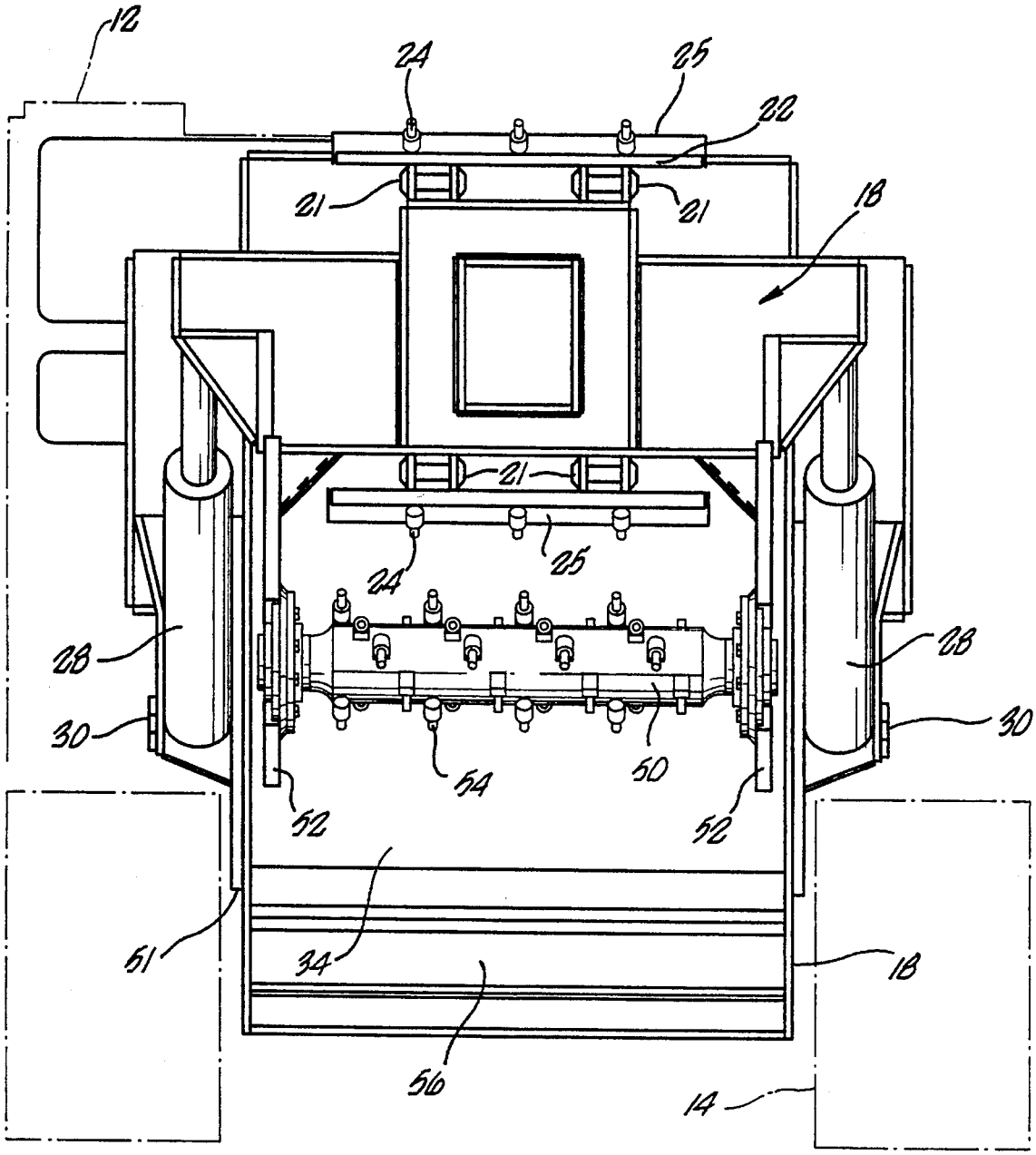
FIG. 3 is a cross sectional isolation end view of the boom apparatus (in the elevated position) showing the crusher drum in greater detail and, for clarity, omitting depiction of a digging belt.

The digging belt 20, as seen in cross-section in FIG. 3, comprises a number of plates 22 to which are attached a plurality of digging teeth 24 and scraping plates 25. The digging belt 20 is caused to rotate continuously around the periphery of the boom 19 by a typical power take-off mechanism 26 attached to the boom frame 18 of the trencher. In the preferred embodiment, this mechanism comprises a conventional belt drive system.

The power plant (not shown) housed within the engine compartment 10 should be of sufficient power output to turn the track system 14 and the digging belt 20, and to provide hydraulic power to raise and lower the boom assembly 16 and to power the conveyor belt system 40. Appropriate and typical clutch means (not shown) are provided so that power to the digging belt 20 can be engaged or disengaged at will.

Figure 2:
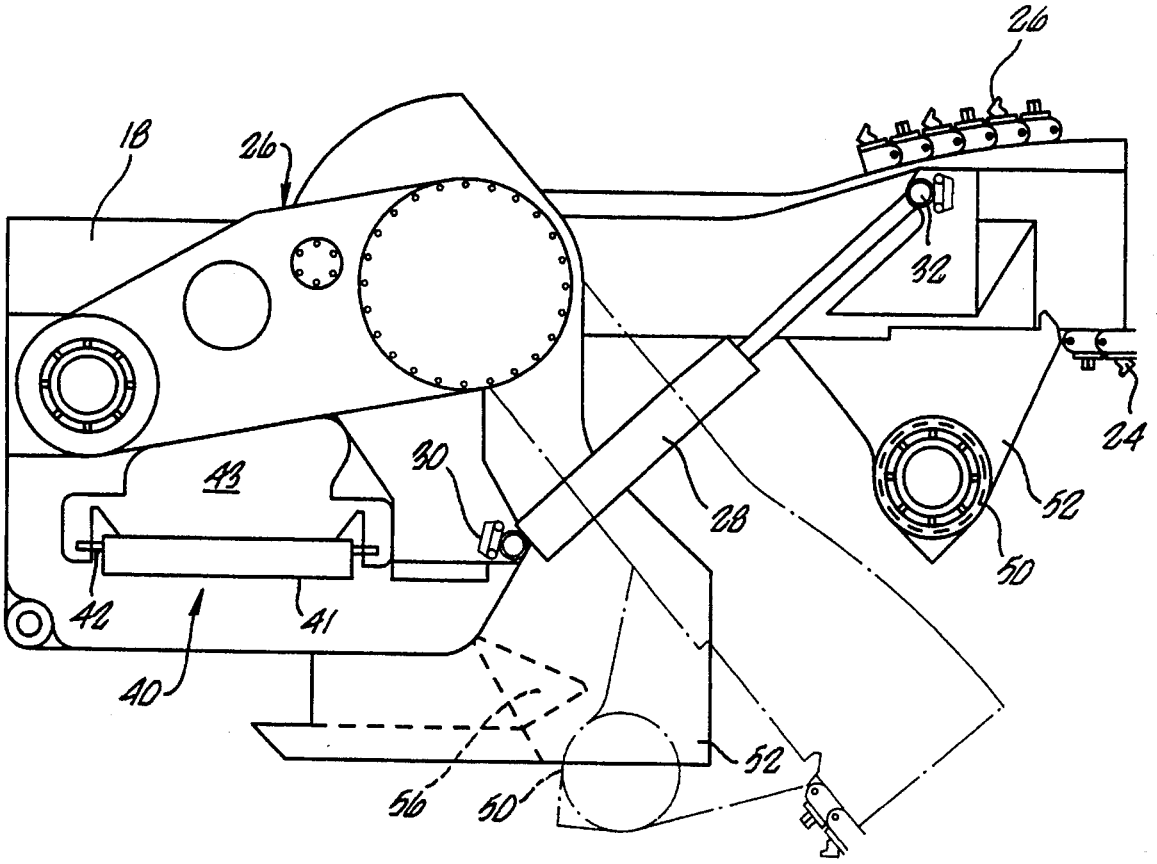
FIG. 2 is a side view in isolation, of that portion of the trenching machine wherein the bar-like crusher element is located. The boom is shown in the up or elevated position, and is shown in shadow in the down or lowered position.

The boom assembly 16 is raised or lower by means of two hydraulic arms 28 attached at one end by typical rotatable means 30 to the boom frame 18 of the trenching machine, and at the other end by similar attachment means 32 to the boom 19. As will be seen in FIG. 2, as the hydraulic arms 28 are extended, the boom 19 is moved up and out of the hole, and as the hydraulic arms 28 are retracted, the boom 19 is lowered into contact with the ground. As best seen in FIG. 1, the weight of the boom 19 and the forward motion of the track system 14 provide for sufficient friction between the digging belt 20 and the ground so that trenching occurs.

In operation, the trencher is positioned so that its tracks straddle the location in the ground where the trench is to be dug, with the boom 19 in a completely elevated position, out of the ground.

To begin the trenching operation, power is supplied to the boom assembly 16 such that the digging belt 20 is caused to rotate around the periphery of the boom 19. The operator of the trencher then releases the hydraulic pressure to the arms 28, allowing the boom assembly 16 to lower against the ground. The digging teeth 24 on the digging belt 20 dislodge the dirt and the scraping plates 25 pull material up and out of the ground, creating a trench. Once the boom 19 has reached the desired depth in the ground, the track system 14 is engaged and the trencher moves forward bringing the submerged portion of the boom assembly 16 and the digging teeth 24 on the digging belt 20 into contact with new ground, thereby extending the length of the trench.

The material that is loosened from the ground is urged upward into a chute 34 formed integrally into the boom frame 18 on the trenching machine. The chute 34 directs the excavated material through the interior of the frame 18, where it empties onto the conveyer belt system 40, consisting of a flexible conveyor belt 41 looped around interior rollers 42 and a drive mechanism at either end of the belt (not shown). The conveyor belt 41 extends out from the side of the trenching device a safe distance away from the trench being cut, where the refuse material is dumped, to be later used for back-filling the hole after the pipe or other appliance has been placed in the trench. Because of the tremendous volume of material that large trenchers can remove from the ground, the conveyer belt typically moves at 1000 ft. per minute, and is approximately 3 ft. wide. It too is powered by the power plant in the engine compartment 10.

A window 43 is created in the frame 18 through which the conveyor belt 41 extends. The size of the window 43 is made as large as possible given the surrounding structure, so as not to unduly impede the movement of the refuse material exteriorly of the trencher. In most trencher designs, however, there is a upper limit to the size of window 43. Accordingly, in operation, it was not unusual for the trencher to dislodge a boulder that would not fit through the window 43. The digging belt 20 would transport the boulder into the chute 34 and onto the conveyer belt system 40. If the boulder were sufficiently large, the conveyer belt system 40 may be damaged simply from the weight and rough exterior of the boulder when it is dropped on the moving conveyer belt 41. Also, because the conveyer belt 41 is moving at such a high rate of speed, and the boulder may be too heavy and have too much inertia to be made immediately to move at the rate of speed of the conveyer. In that not uncommon circumstance, the boulder begins to roll in place. This can further damage the conveyer belt assembly, or create an obstacle which prevents the free flow and removal of the other refuse material. If the boulder does move and is too large to fit through the window 43, the high speed of the conveyer belt 41 causes the boulder to become securely wedged in the window 43.

When this happens, the trenching operation must completely stop so that the boulder can be removed. Often, the ground being trenched will include some amount of water in the soil, such that the dirt has a consistency of mud, making the removal process not only time-consuming and inconvenient, but also extremely dirty. Sometimes, because of the size of the boulder, it must be chained and lifted out of the boom frame 18 by another apparatus.

This problem is effectively corrected by the addition of a crusher drum 50 which is rotatably attached to and between flanges 52, which are in turn securely attached one to either side of the boom frame 18. The crusher drum 50 is perpendicular to and extends the entire distance of and beyond the digging belt 20. The crusher drum 50 is fitted with a plurality of teeth 54, which are angled toward the teeth 24 on the digger belt 20. A clearance between the teeth 54 and the teeth 24 of approximately eight (8) inches has been found to be workable. This distance, however, can be varied according to the size of the trenching machine and the size of the material being encountered. Any of the commercially available long-wearing, hard-faced digging, drilling or trenching teeth should provide acceptable performance. The preferred teeth, however, are obtained from Kenametal Corp.

A stop plate 56 is attached to the bottom portion of boom frame 18. When the boom 19 is in its lowered positions, the stop plate 56 resides immediately behind the crusher drum 50 to protect it from back wash of refuse material down the chute 34.

In operation, if a boulder is dislodged from the material being trenched, it is carried up and out of the trench by the digging belt 20. Whereas in the prior art machines, the boulder would be lifted into the chute 34 and hence onto the conveyor belt system 40, and maybe or maybe not, through the window 43, with this invention that boulder in this device, if the boulders cannot fit through the space between the crusher drum 50 and the digging belt 20, it becomes lodged against the crusher drum 50, held in place there by the crusher drum 50 on one side, the ground on another side, and the belt 20 on the third side. If the boulder is not broken apart by the resultant forces, it remains in that position while the belt continues to abrade it until reduced to a sufficiently small size to be safely expelled.

Described above is the preferred embodiment of this invention. The scope of the invention, however, is not so limited, but is of the full breadth of the following claims.

What is claimed is:

1. In a machine for digging a trench, which machine comprises a frame, a power source attached to the frame, a motive system attached to the frame for moving the machine, a trenching component attached to the frame for digging the trench, said trenching component comprising an elongated boom having a digging belt movable about its periphery, said belt having a plurality of teeth attached thereto, and dirt-removal means for moving the trenched material from the trench through the frame of the machine to the side of the trench, the improvement comprising means to crush boulders which are dislodged intact by the trenching component, said means comprising a bar-like element attached to the frame in close proximity to the digging belt between the digging belt and the ground such that dislodged boulders which are too large to be handled by the dirt removal means are prevented from entering the dirt-removal means.

2. The improvement of claim 1 in which the bar-like element is rotatable.

3. The improvement of claim 1 in which the bar-like element has teeth.

4. The improvement of claim 1 in which the bar-like element is a drum.

5. The improvement of claim 1 in which the bar-like element is a rotatable drum.

6. The improvement of claim 1 in which the bar-like element is a rotatable drum having teeth.

7. The improvement of claim 3 in which the teeth are angled opposite to the movement of the belt.

8. The improvement of claim 6 in which the teeth are angled opposite to the movement of the belt.

9. The improvement of claim 1 in which the bar-like element is approximately eight (8) inches from the belt.

10. A trenching component to be attached to a trenching machine, the trenching machine having dirt removal means, the component comprising:

a) an attachment frame by which the component will be attached to the machine;

b) an elongated boom having an upper side and a lower side rotatably attached at one end to the attachment frame whereby the boom can be raised or lowered;

c) means attached to the attachment frame for raising and lowering the boom;

d) a track around the periphery of the boom;

e) a digging belt movably attached to the track, said belt having a plurality of digging teeth extending outwardly therefrom; and f) a bar attached to the attachment frame in close proximity to the chain on the lower side of the boom to prevent boulders, which are dislodged during trenching and which are too large to be handled by the dirt removal means, from entering the dirt removal means.

11. The invention of claim 10 in which the bar is rotatable.

12. The invention of claim 10 in which the bar has teeth.

13. The invention of claim 10 in which the bar is a drum.

14. The invention of claim 10 in which the bar is a rotatable drum.

15. The invention of claim 10 in which the bar is a rotatable drum having teeth.

16. The invention of claim 12 in which the teeth are angled opposite to the movement of the chain.

17. The invention of claim 15 in which the teeth are angled opposite to the movement of the chain.

18. The invention of claim 10 in which the bar is approximately eight (8) inches from the chain.

* * * * *